US005522319A

United States Patent [19]

Haselman, Jr.

[11] Patent Number: 5,522,319

[45] Date of Patent: Jun. 4, 1996

[54] FREE FORM HEMISPHERICAL SHAPED CHARGE

[75] Inventor: Leonard C. Haselman, Jr., Livermore, Calif.

[73] Assignee: The United States of America as represented by the United States Department of Energy, Washington, D.C.

[21] Appl. No.: 270,713

[22] Filed: Jul. 5, 1994

[51] Int. Cl.[6] ..... F42B 1/028; F42B 12/10

[52] U.S. Cl. ..... 102/306; 102/476; 175/4.6

[58] Field of Search ..... 102/306–310, 102/476; 175/4.6

[56] References Cited

U.S. PATENT DOCUMENTS

| | | | |
|---|---|---|---|
| 2,426,997 | 9/1947 | Gray et al. | 102/56 |
| 2,605,704 | 8/1952 | Dumas | 102/24 |
| 3,176,613 | 4/1965 | Godfrey et al. | 102/307 |
| 3,613,585 | 10/1971 | Dubroff | 102/95 |
| 3,732,816 | 5/1973 | Muller | 102/307 |
| 3,750,582 | 8/1973 | Kintish et al. | 102/308 |
| 4,421,030 | 12/1983 | DeKoker | 102/218 |
| 4,450,768 | 5/1984 | Bell | 102/307 |
| 4,498,367 | 2/1985 | Skolnick et al. | 86/1 R |
| 4,829,901 | 5/1989 | Yates, Jr. | 102/306 |
| 4,860,655 | 8/1989 | Chawla | 102/306 |
| 5,175,391 | 12/1992 | Walter et al. | 102/307 |
| 5,279,228 | 1/1994 | Ayer | 102/306 |
| 5,320,044 | 6/1994 | Walters | 102/475 |

*Primary Examiner*—Harold J. Tudor

*Attorney, Agent, or Firm*—John P. Wooldridge; William C. Daubenspeck; William R. Moser

[57] ABSTRACT

A hemispherical shaped charge has been modified such that one side of the hemisphere is spherical and the other is aspherical allowing a wall thickness variation in the liner. A further modification is to use an elongated hemispherical shape. The liner has a thick wall at its pole and a thin wall at the equator with a continually decreasing wall thickness from the pole to the equator. The ratio of the wall thickness from the pole to the equator varies depending on liner material and HE shape. Hemispherical shaped charges have previously been limited to spherical shapes with no variations in wall thicknesses. By redesign of the basic liner thicknesses, the jet properties of coherence, stability, and mass distribution have been significantly improved.

13 Claims, 4 Drawing Sheets

FREE FORM HEMISPHERICAL SHAPED CHARGE

The United States Government has rights in this invention pursuant to Contract No. W-7405-ENG-48 between the U.S. Department of Energy and the University of California, for the operation of Lawrence Livermore National Laboratory.

BACKGROUND OF THE INVENTION

1. Field of the Invention

The present invention relates to hemispherical shaped charges. More specifically, it relates to an article comprised of a hemispherical shaped charge with a liner which has a thick wall at its pole and a thin wall at its equator.

2. Description of the Related Art

The structure of most hemispherical shaped charges consists of a case, base plate, charge, and liner. In these shaped charges, the inner and outer surfaces of the liner are spherical or parallel one to the other. The jets produced by these hemispherical charges suffered from major disadvantages; they had jets which had tip velocities which were much lower than those achieved with conical jets.

Following the experience of World War II in which portable anti-tank weapons were developed using explosive charges in various shapes to enhance the armor penetration capacity of such projectiles, it became apparent that shaped charges had potential for use in weapon systems and other areas. The shaped charge came into use as an oil well perforating device for the purpose of enhancing rate of flow in an oil well. The typical shaped charge had a cavity or recess in the forward end of an explosive projectile, and the cavity was typically lined with a dense material such as copper. In use, when the explosive charge was ignited, the detonation wave engaged the metal liner, causing the liner to collapse inwardly upon itself into the cavity. As the collapsing liner reached the center of the cavity, a small forward portion of the liner formed a jet of hot material which was then responsible for the relatively deep penetration achieved in early oil well perforating devices.

The remainder of the collapsed liner formed a large slug of material which followed the advancing energy jet at a lower velocity and contributed little or nothing to penetration. The depth of penetration into the well by the jet depended then, as it does today, on the characteristics of the material of which the liner is made. In general, it is agreed that the liner material for a shaped charge should have a high density and be capable of flowing smoothly into a long jet. Subsequent years of experimentation in this field have brought several developments in an attempt to provide deeper penetration with greater efficiency; however, the full potential of the shaped charge device was not achieved, While some of these developments have provided small or moderate increases in penetration, little has been recognized of the fundamental scientific principles and the necessary qualities in liner materials and design to transfer the greatest amount of energy from the explosive detonation to the oil well. It is therefore desirable to have a shaped charge that produces a jet with significantly increased stability, coherence, and mass distribution over present designs. The present invention provides such an article.

SUMMARY OF THE INVENTION

It is an object of this invention to provide a shaped charge with a jet that is stable, coherent, and has a more optimum mass distribution than jets produced by prior art designs.

It is also an object of this invention to provide an improved shaped charge for oil well perforation.

The invention relates to a free form hemispherical shaped charge that has been modified such that the liner is aspherical and allows an aspherical wall thickness variation. The liner has a thick wall at its pole and a thin wall at the equator with a continually decreasing wall thickness from the pole to the equator. The ratio of the wall thickness from the pole to the equator varies depending on the liner material and the desired jet properties. Hemispherical shaped charges have previously been limited to spherical shapes with small variations in wall thicknesses. By redesign of the basic liner thicknesses and using an elongated hemispherical shape the coherence, stability, and mass distribution of the jet have been significantly improved, and the tip velocity can be increased so that it is comparable to that of a conical shaped charge. By variation of the liner thickness ration and HE shape, the jet mass distribution and velocity may be optimized for a particular application.

DETAILED DESCRIPTION OF THE INVENTION

Figure 1:
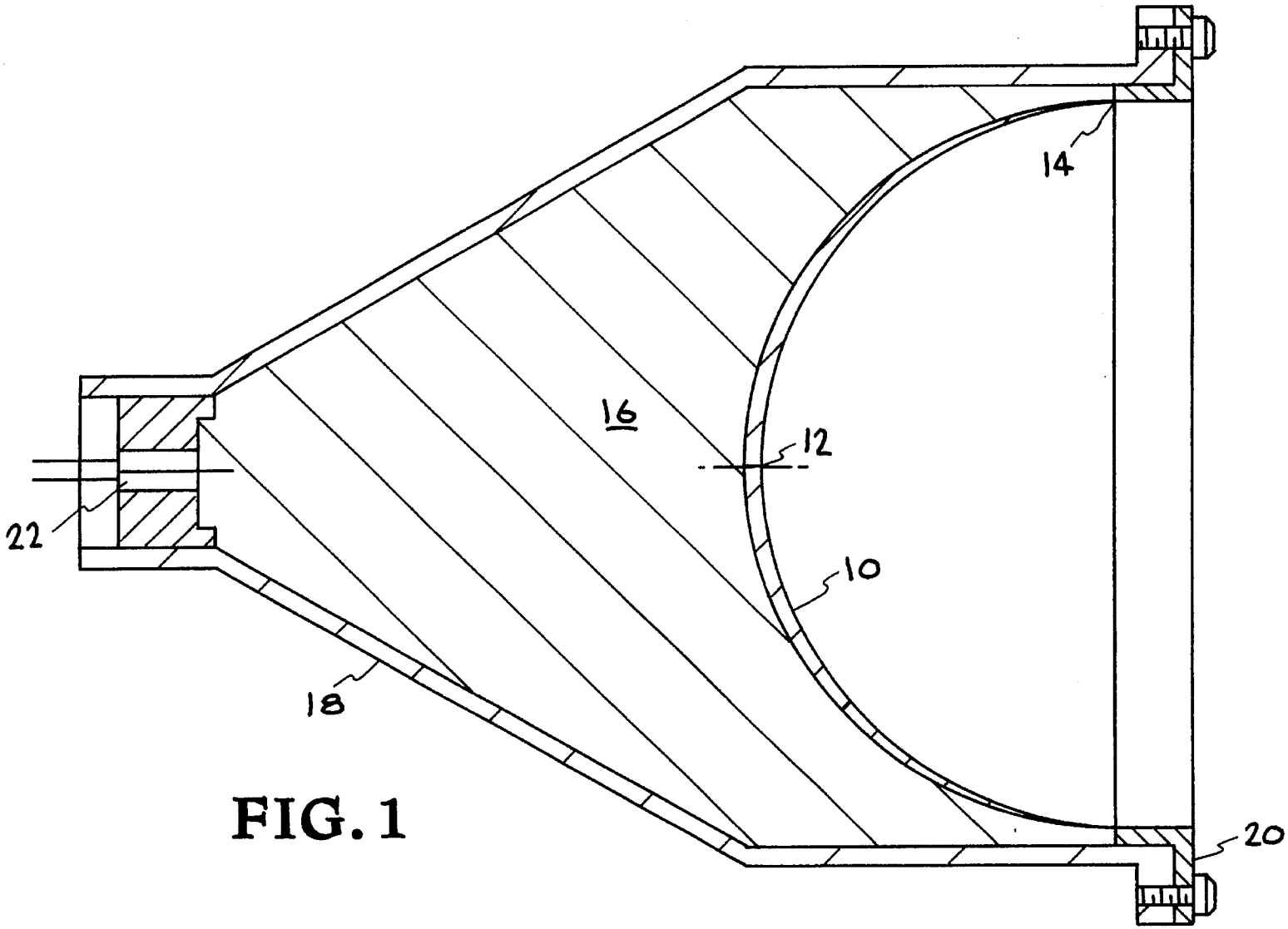
FIG. 1 shows an embodiment of the present invention.

One Embodiment of the present invention, as shown in FIG. 1, relates to a hemispherical shaped charge that has been modified to allow a wall thickness variation in liner 10. Liner 10 has a thick wall at pole 12 and a thin wall at equator 14 with a continually decreasing wall thickness from pole 12 to equator 14. The ratio of wall thickness from pole 12 to equator 14 varies depending on the liner material and the desired jet properties. Liner 10, known as a contoured hemispherical liner, is glued into high explosive charge 16. Liner 10 and charge 16 are held in place within case 18 by retainer 20. Liner 10 has an outside surface 24 that is aspherical and an inside surface 26 that is spherical allowing a wall thickness variation in liner 10. Liner 10 and charge 16 are detonated by detonator 22 embedded within charge 16. Liner 10 is made of a single material. Some of the materials found to be well suited for use are uranium, tantalum, molybdenum, copper, titanium, and aluminum. The ratio of wall thickness from pole 12 to equator 14 varies between greater than 1 to 1 and 2 to 1 for tanatalum; 2 to 1 and 7 to 1 for molybdenum; 3 to 1 and 9 to 1 for titanium; and 4 to 1 and 13 to 1 for aluminum. Contoured hemispherical shaped charge designs in copper and molybdenum produce jets that are stable and coherent. In addition, the contoured liner design results in more optimun mass distribution for penetration and stablization of the tail of the jet.

The formation process for a jet from a hemi shaped charge is fundamentally different from that for a conical charge, and it produces a jet with significantly different characterisitics. The formation process is very dynamic, and more complex than that of a conical or conventional hemispherical shaped charge. Several factors appear to influence the performance of the hemi shaped charge design. The dominant design control for these jets is the thickness variation of the liner. Non-analytic or free-form (i.e., cut and try) thickness profiles are necessary for optimum control of the jet properties. Next in importance is the shape of the liner; a slightly prolate shape is better than a spherical shape. The length of the high explosive (HE) and the sub-caliber of the liner are also important. Mass distribution in the jet is controlled by the thickness and shape of the liner and HE. The case material and configuration are of little importance to the overall design optimization; however, they do have an effect and need to be included in any detailed design.

Figure 2:
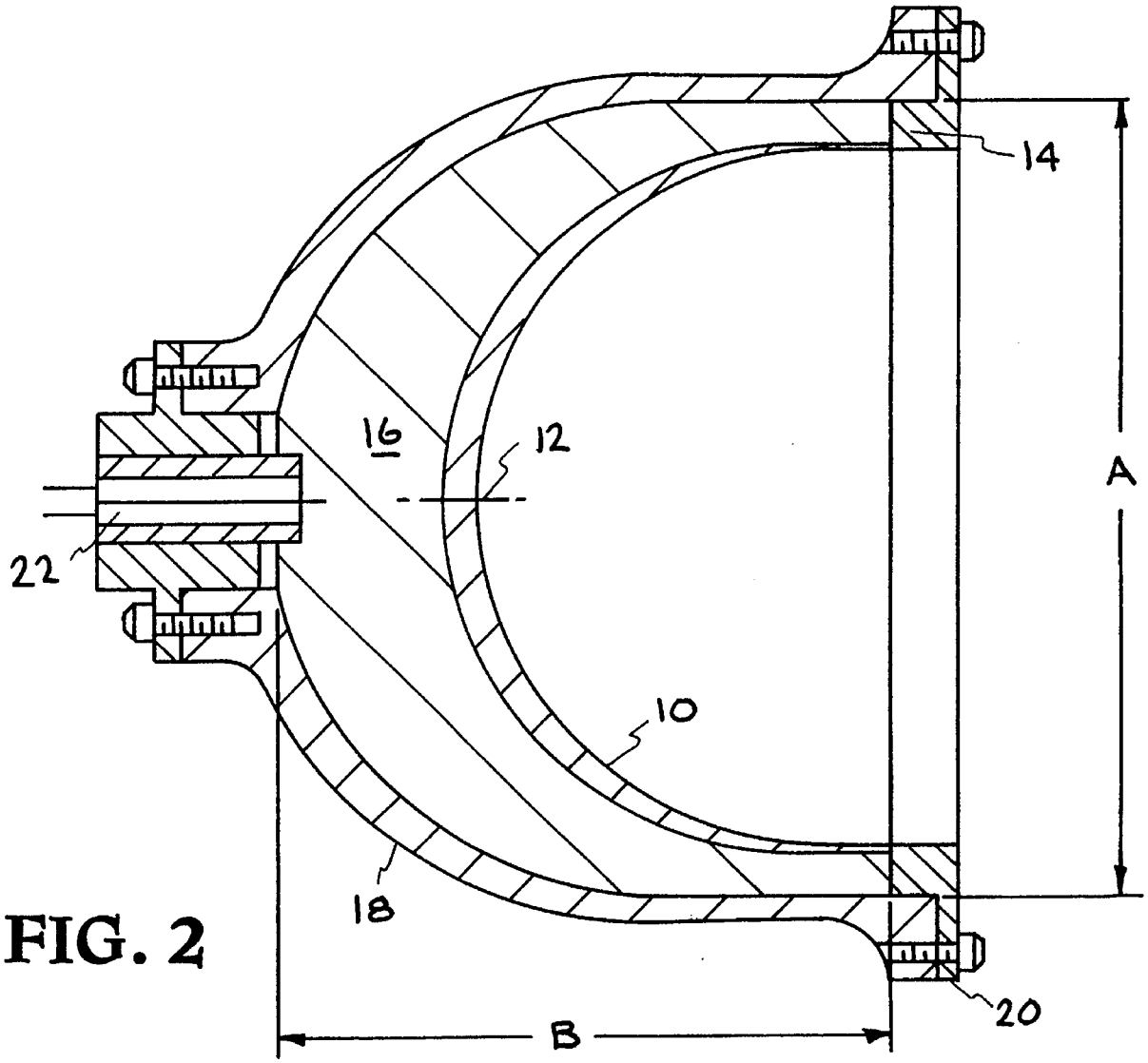
FIG. 2 shows a preferred embodiment of the present invention.
Figure 3A:
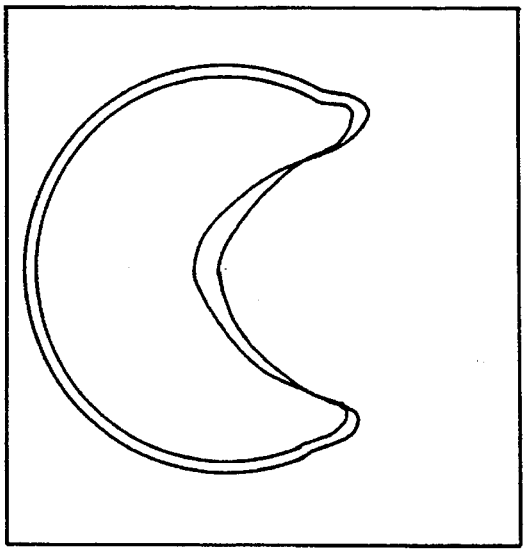
FIG. 3(*a*) through 3(*d*) illustrate the basic jet formation process.
Figure 3B:
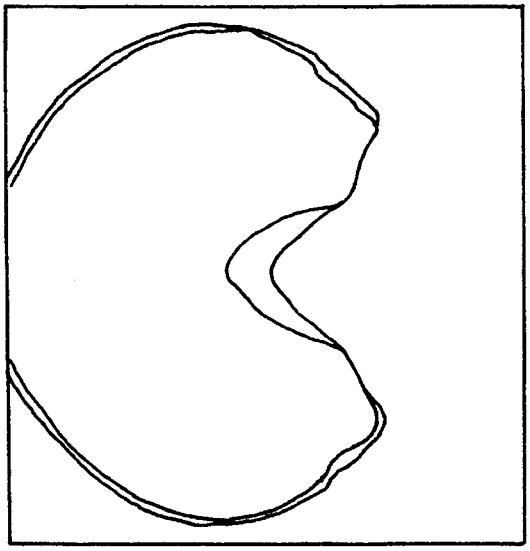
Figure 3C:
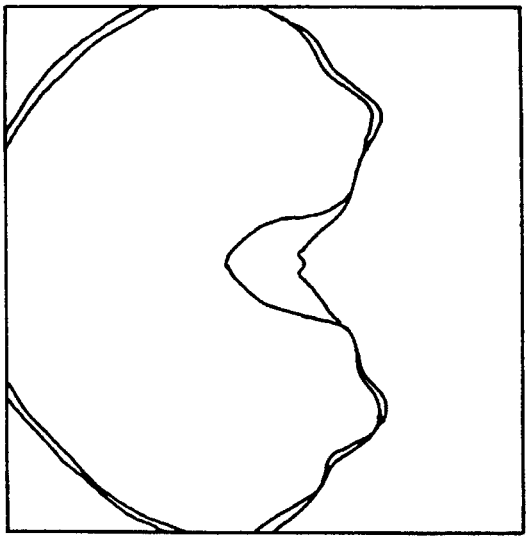
Figure 3D:
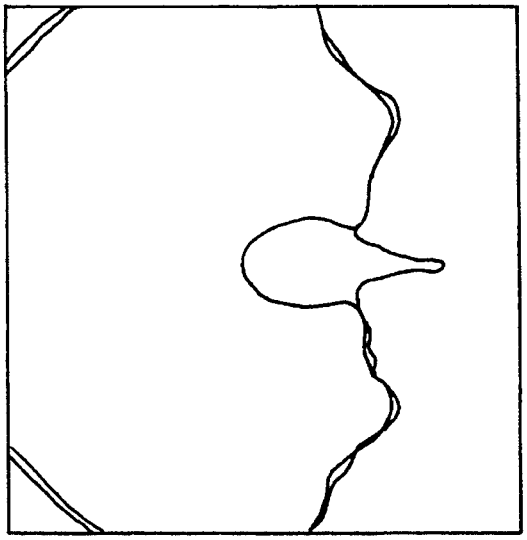
Figure 4:
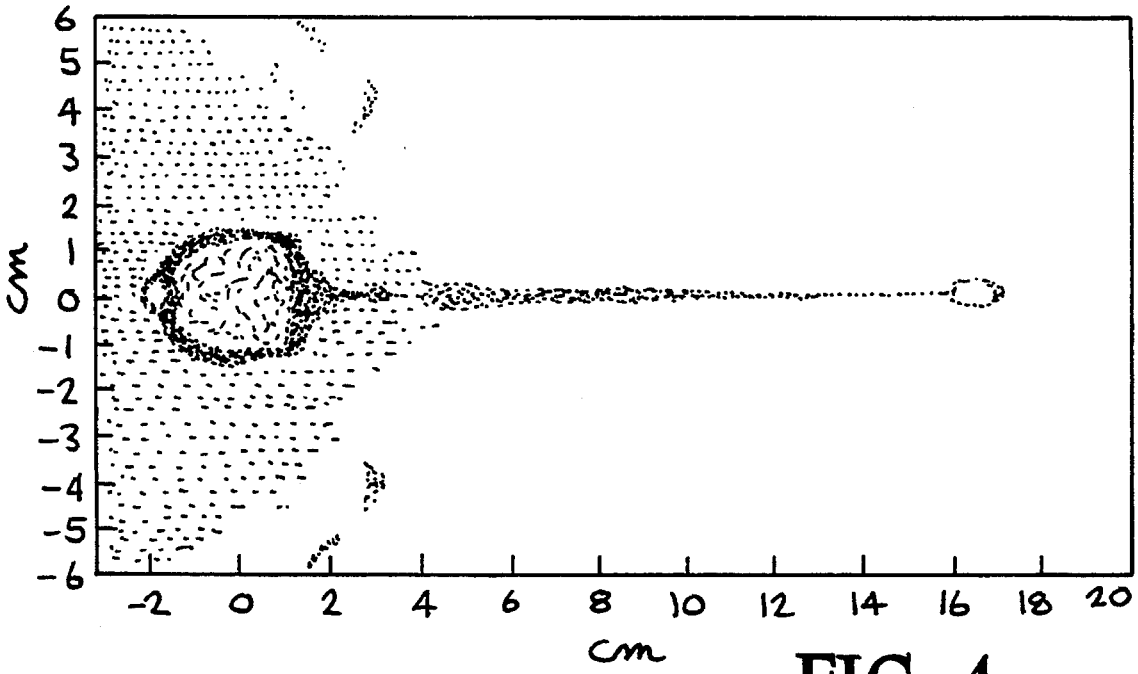
FIG. 4 is a calculated density plot of a jet.

The basic shape of one embodiment, shown in FIG. 2, is similar to the embodiment shown in FIG. 1, with like parts identically numbered. This configuration produces a jet with good mass distribution, stability, and coherence over the length of the jet. Excluding the case and base plate, the charge is 90 mm in diameter at A and 73 mm long at B. This design is scalable over a considerable range. The shortness of this design helps to stablize the tail of the jet and allows the kinetic energy of the jet to be moved towards the tip. By changing the contour of the inside surface of the liner (i.e., liner thickness), the charge can accommodate a variety of liner materials with a wide range of tip velocities. In FIGS. 3(*a*) through 3(*d*), the basic jet formation process is shown. The liner material is copper. FIG. 3(*a*) shows the configuration after HE burn; FIG. 3(*b*) shows the formation of a dynamic cone, which increases the tip speed; FIG. 3(*c*) shows the tip formation; and FIG. 3(*d*) shows the subsequent development of the jet. FIG. 4 shows a density plot of the jet development at about two charge diameters (CDs). Since the configuration of a shaped charge is scalable over a wide range, the outside diameter of the high explosive (HE) is used as a reference number. The mass distribution of this jet is uniform when compared to previous designs, which had an overall triangular shape with most of the mass of the jet in the tail. A jet is said to be coherent if it remains solid as opposed to radially expanding. If a jet breaks apart as it stretches or elongates, particulation is said to occur. These effects limit the penetration potential of the jets. This new mass distribution improves the penetration of the jet by reducing the interference of the tail of the jet with the entrance hole.

Figure 5:
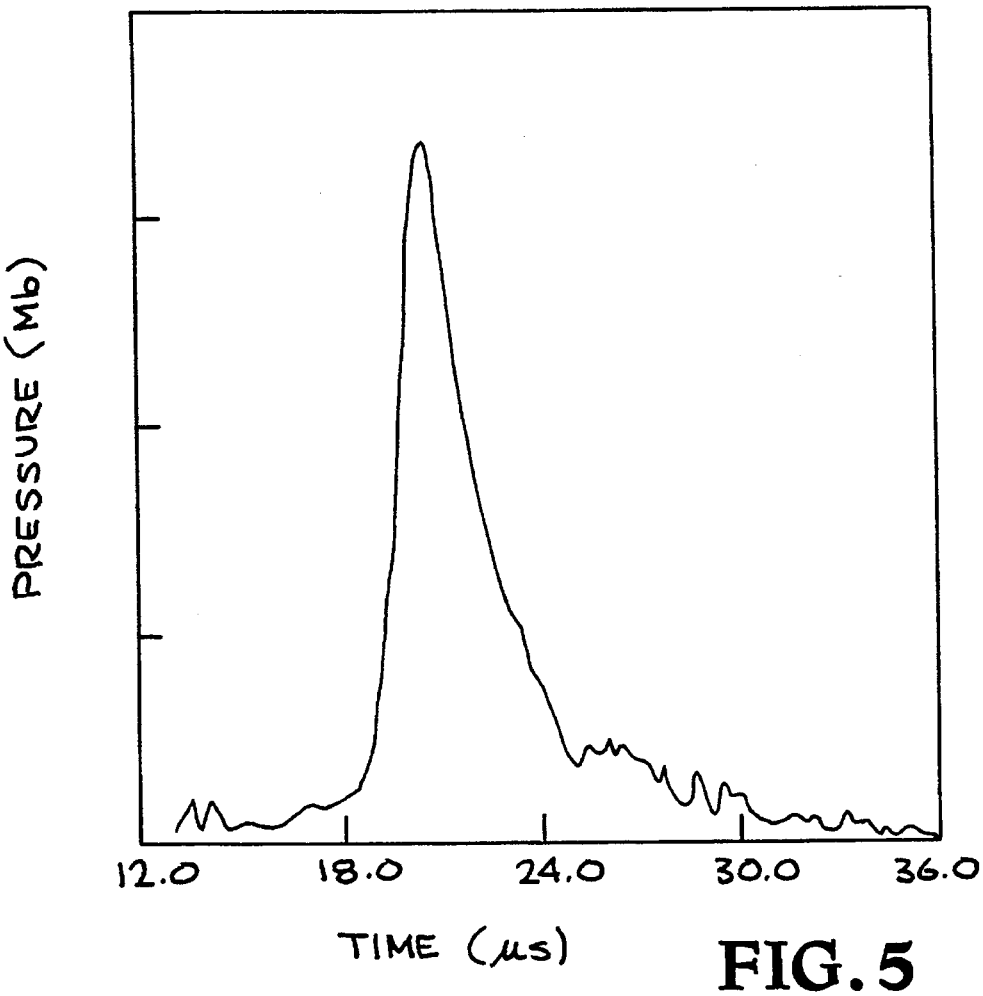
FIG. 5 presents relative jet pressure as a function of time.

FIG. 5 shows the relative pressure in the jet as a function of time. The pressure rises to a peak, which occurs at the tip formation time. The pressure then gradually releases. The shape of this release determines the stability of the tail of the jet. Previous designs had a second pressure rise caused by an uneven feed rate of material into the tail. This led to the incoherence of the tail observed in those jets.

Changes and modifications in the specifically describes embodiments can be carried out without departing from the scope of the invention, which is intended to be limited by the scope of the appended claims.

I claim:

1. A hemispherical shaped charge comprising:

a. a contoured liner having a greater thickness at the pole than at the equator, wherein said liner has an outside surface that is aspherical and an inside surface that is spherical;

b. a charge explosive;

c. a case; and d. a detonator.

2. A shaped charge as recited in claim 1, wherein said liner has a continuously decreasing wall thickness variation from pole to equator.

3. A shaped charge as recited in claim 2, wherein said continously decreasing wall thickness variation from pole to equator varies between greater than 1 to 1 and 13 to 1.

4. A shaped charge as recited in claim 3, wherein said liner is formed from a material selected from a group consisting of uranium, tantalum, molybdenum, copper, titanium, and aluminum.

5. A shaped charge as recited in claim 4, having a charge diameter of 90 mm.

6. A shaped charge a recited in claim 5, having a charge length of 73 mm.

7. The shaped charge as recited in claim 1, wherein said liner is formed from tantalum and wherein said variation varies between greater than 1 to 1 and 2 to 1.

8. The shaped charge as recited in claim 1, wherein said liner is formed from molybdenum and wherein said variation varies between 2 to 1 and 9 to 1.

9. The shaped charge as recited in claim 1, wherein said liner is formed titanium and wherein said variation varies between 3 to 1 and 9 to 1.

10. The shaped charge as recited in claim 1, wherein said liner is formed from aluminum and wherein said variation varies between 4 to 1 and 13 to 1.

11. In a shaped charge having a liner, a charge explosive, a case, and a detonator, the improvement comprising:

said liner being contoured to decrease in thickness from a pole section to an equator section thereof, wherein said liner has an outside surface that is aspherical and an inside surface that is spherical.

12. The improvement of claim 11, wherein said liner is hemispherically shaped.

13. The improvement of claim 12, wherein said liner has a continuously decreasing wall thickness variation from pole to equator.

* * * * *